United States Patent [19]

De La Vega, Jr.

[11] Patent Number: 5,039,015

[45] Date of Patent: Aug. 13, 1991

[54] SPRINKLER HEAD SHIELD APPARATUS

[76] Inventor: Allejandro De La Vega, Jr., 3105 Hector, El Paso, Tex. 79935

[21] Appl. No.: 493,787

[22] Filed: Mar. 15, 1990

[51] Int. Cl.[5] ..... B05B 15/04

[52] U.S. Cl. ..... 239/288; 239/DIG. 1

[58] Field of Search ..... 239/230–232, 239/288–288.5, DIG. 1, 524; 5/431, 432, 420

[56] References Cited

U.S. PATENT DOCUMENTS

| | | | |
|---|---|---|---|
| 1,147,763 | 7/1915 | Terry | 239/52 X |
| 2,061,664 | 11/1936 | Lincoln | 5/420 X |
| 3,004,652 | 11/1961 | McKay | 239/231 |
| 3,323,151 | 6/1967 | Lerman | 5/420 X |
| 4,461,423 | 7/1984 | Davis | 239/231 |

*Primary Examiner*—Andres Kashnikow
*Assistant Examiner*—Kevin Weldon
*Attorney, Agent, or Firm*—Leon Gilden

[57] ABSTRACT

An apparatus readily transportable for positioning adjacent an operative sprinkler head during adjustment and maintenance thereof to protect an individual from the operative sprinkler. The apparatus is defined by a rigid polymeric plate member utilizing a through extending group opening formed therethrough with undulating upper end surface of the grip member to assist in secure grasping of the plate member. The invention may further include utilization of a screen diffuser housing mounted forwardly of the plate member and wherein the diffuser housing may further include an interior sponge layer to diffuse water spray directed from the sprinkler head and to permit absorbtion of the water by the sponge and permit the saturated sponge to direct the water downwardly of the sponge and apparatus.

3 Claims, 4 Drawing Sheets

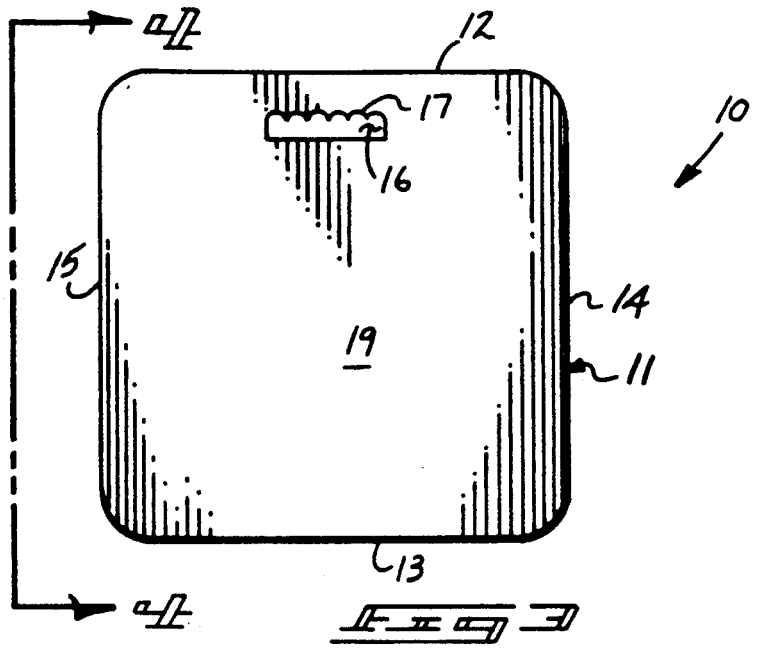
Fig 3
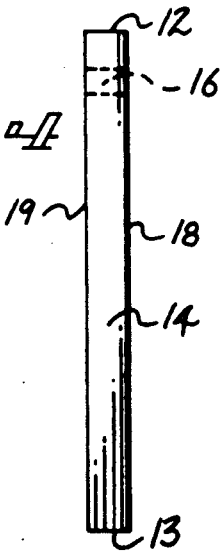
Fig 4
Fig 5
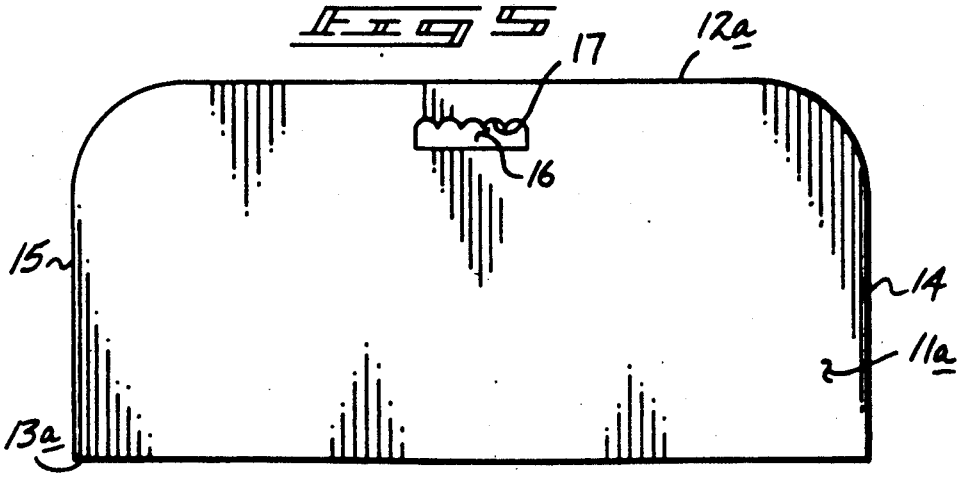

SPRINKLER HEAD SHIELD APPARATUS

BACKGROUND OF THE INVENTION

1. Field of the Invention

The field of the invention relates to sprinkler head apparatus, and more particularly pertains to a new and improved sprinkler head shield apparatus wherein the same permits adjustment and maintenance of an operative sprinkler head protecting an individual from undue contact with water directed from the sprinkler head exteriorly thereof.

2. Description of the Prior Art

Sprinkler head shields of various types are known in the prior art. Heretofore, shields have been of a type to be permanently attached to the sprinkler head or in a surrounding relationship relative thereto as part of the operative structure of the sprinkler head.

The instant invention attempts to overcome the deficiencies of the prior art by providing a temporary shield structure to permit access to a working sprinkler head by an individual to provide maintenance adjustment thereto and not to provide permanent reflection of water from the sprinkler head subsequent to the maintenance and repair procedure. Examples of the prior art include U.S. Pat. No. 3,009,652 to MCKAY wherein a sprinkler head attachment is operative as a shield utilizing a plurality of spaced clamps securable about a stand-pipe of a sprinkler head with the clamps are attachable to elongate rod and the rod adjustably mounts a plate at an upper end thereof to deflect sprinkler head spray.

U.S. Pat. No. 4,461,223 to DAVIS illustrative of a permanently attached sprinkler head apparatus wherein a rod like member is fixedly mounted to a stand-pipe of a sprinkler head wherein the rod member includes an arcuate deflecting shield in surrounding relationship relative to the head to deflect and orient a sprinkler head spray in a predetermined orientation.

U.S. Pat. No. 3,703,993 to SCHREINER sets forth a lawn watering shield arrangement wherein a bracket arrangement is fixedly mounted to a stand-pipe of a sprinkler head to overlie the sprinkler head with a roof portion overlying the sprinkler head to provide desired spray orientation of the sprinkler head in a predetermined pattern.

U.S. Pat. No. 3,888,417 to HARMAN sets forth a variable water volume sprinkler head having a single nozzle producing a selectable spray pattern with respect to a rotor direction wherein the sprinkler head includes a cylindrical shield surrounding the nozzle.

U.S. Pat. No. 2,423,287 to BEISEL sets forth a manner of deflecting an array of particles such as utilized in a abrasive milling machine in a particular pattern.

As such, it may be appreciated that there continues to be a need for a new and improved sprinkler head shield apparatus wherein the same addresses both the problems of ease of use as well as effectiveness in construction in providing portability in positioning the organization in a temporary relationship to a sprinkler head and in this respect, the present invention substantially fulfills this need.

SUMMARY OF THE INVENTION

In view of the foregoing disadvantages inherent in the known types of sprinkler head shield apparatus present in the prior art, the present invention provides a new and improved sprinkler head shield apparatus wherein the same provides a portable plate member selectively positioned all about a sprinkler head to provide temporary deflection of water spray from the sprinkler head to provide ease of access to the sprinkler head for maintenance and adjustment thereof. As such, the general purpose of the present invention, which will be described subsequently in greater detail, is to provide a new and improved sprinkler head shield apparatus which has all the advantages of the prior art sprinkler head shield apparatus and none of the disadvantages.

To attain this, the sprinkler head shield apparatus of the instant invention includes an apparatus readily transportable for positioning adjacent an operative sprinkler head during adjustment and maintenance thereof to protect an individual from the operative sprinkler. The apparatus is defined by a rigid polymeric plate member utilizing a through extending group opening formed therethrough with undulating upper end surface of the grip member to assist in secure grasping of the plate member. The invention may further include utilization of a screen diffuser housing mounted forwardly of the plate member and wherein the diffuser housing may further include an interior sponge layer to diffuse water spray directed from the sprinkler head and to permit absorbtion of the water by the sponge and permit the saturated sponge to direct the water downwardly of the sponge and apparatus.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sprinkler head shield apparatus which has all the advantages of the prior art sprinkler head shield apparatuses and none of the disadvantages.

It is another object of the present invention to provide a new and improved sprinkler head shield apparatus which may be easily and efficiently manufactured and marketed.

It is a further object of the present invention to provide a new and improved sprinkler head shield apparatus which is of a durable and reliable construction.

An even further object of the present invention is to provide a new and improved sprinkler head shield apparatus which is susceptible of a low cost of manufacture with regard to both materials and labor, and which accordingly is then susceptible of low prices of sale to the consuming public, thereby making such sprinkler head shield apparatuses economically available to the buying public.

Still yet another object of the present invention is to provide a new and improved sprinkler head shield apparatus which provides in the apparatuses and methods of the prior art some of the advantages thereof, while simultaneously overcoming some of the disadvantages normally associated therewith.

Still another object of the present invention is to provide a new and improved sprinkler head shield apparatus which may be compactly stored when not being utilized.

Yet another object of the present invention is to provide a new and improved sprinkler head shield apparatus wherein a readily manipulatable and portable shield is selectively positionable adjacent a sprinkler head to provide adjustment and maintenance thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic frontal view taken in elevation of the instant invention.

FIG. 4 is an orthographic side view taken in elevation of the instant invention.

FIG. 5 is an orthographic frontal view taken in elevation of elongate shield utilized by the instant invention.

DESCRIPTION OF THE PREFERRED EMBODIMENT

Figure 1:
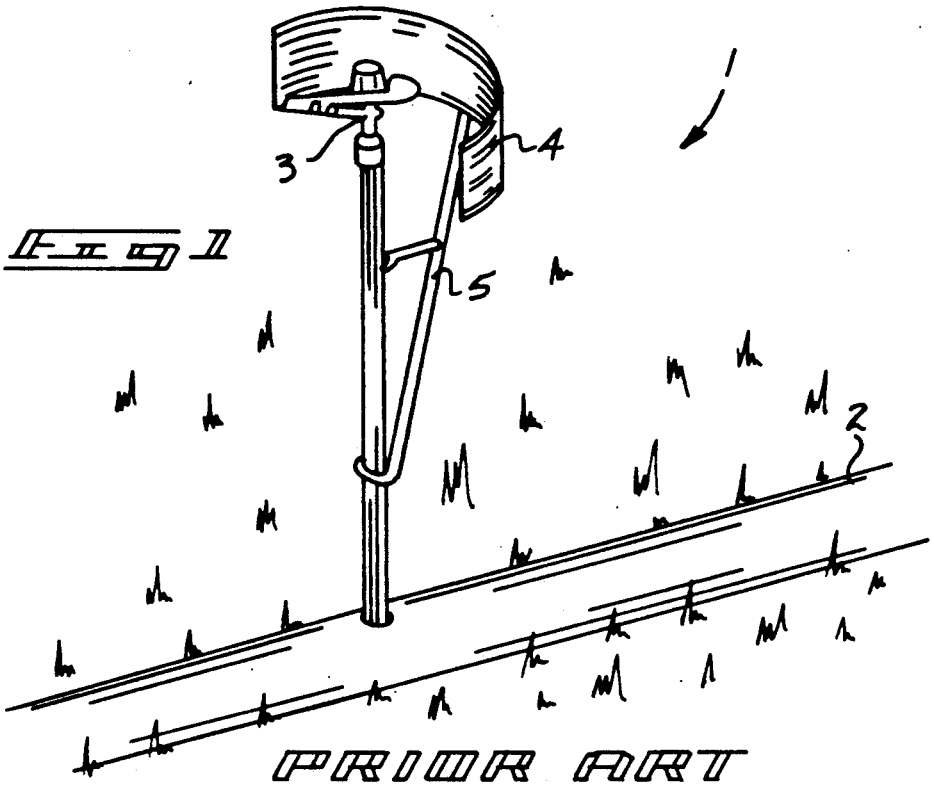
FIG. 1 is an isometric illustration of a prior art sprinkler head shield apparatus.

With reference now to the drawings, and in particular to FIGS. 1 to 9 thereof, a new and improved sprinkler head shield apparatus embodying the principles and concepts of the present invention and generally designated by the reference numeral 10 will be described.

Figure 2:
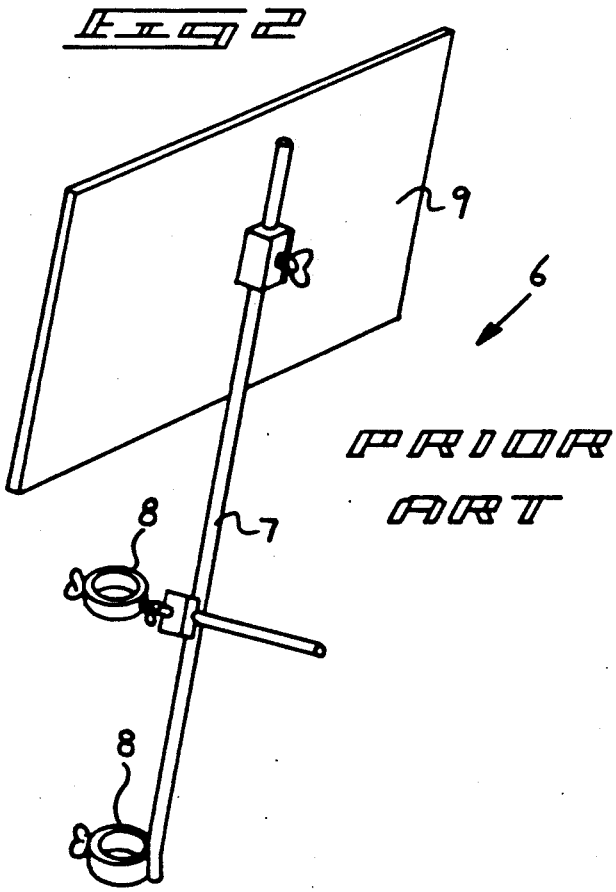
FIG. 2 is an isometric illustration of a further prior art sprinkler head shield apparatus.

FIG. 1 illustrates a prior art sprinkler head shield organization 1 wherein a water conduit 2 is in fluid communication with a stand-pipe mounting a sprinkler head 3 at an upper terminal end thereof wherein the sprinkler head 3 includes an arcuate shield 4 in surrounding relationship thereto fixedly mounted to the stand-pipe by a bracket arrangement 5. FIG. 2 illustrates a further prior art sprinkler head shield 6 wherein a rod member 7 includes a plurality of spaced clamps 8 to secure the clamps to a similar sprinkler head stand-pipe conduit as illustrated in FIG. 1 with a deflector plate 9 positionable in a vertically adjustable manner relative to the sprinkler head and rod 7 to provide shielding of the associated sprinkler head water spray.

More specifically, the sprinkler head shield apparatus 10 essentially comprises a rigid polymeric fluid impermeable rectangular sheet 11. The sheet 11 includes a top edge 12 parallel to and spaced from a bottom edge 13 with a space parallel side edges including a right side edge 14 and a left side edge 15 oriented orthogonally relative to the top and bottom edges. FIG. 5 illustrates a sheet 11*a* utilizing an elongate top edge 12*a* overlying a elongate bottom edge 13*a*. The sheet 11 is a generally of a configuration defining a dimensional range of 10 to 26 inches in width by 10 by 26 inches in height. The modified plate 11*a* includes a length of substantially 36 to 40 inches. The length of the shield is dependent upon the particular spray characteristics of the associated sprinkler head 3 such as illustrated in FIG. 1. The rectangular sheet 11 further includes a rear surface 18 spaced from and parallel to a forward surface 19 defining a dimensional thickness of $\frac{1}{8}$ to $\frac{3}{8}$ inches. An elongate opening 16 is arranged parallel to the top and bottom edges 12 and 13 and positioned adjacent the top edge 12 and including an undulating finger engaging upper surface 17 to enhance manual engagement in a non-slip relationship relative to the opening 16. In this manner, the shield provides protable positioning of the fluid impermeable sheet relative to an operating sprinkler head to permit adjustment and maintenance thereof.

Figure 6:
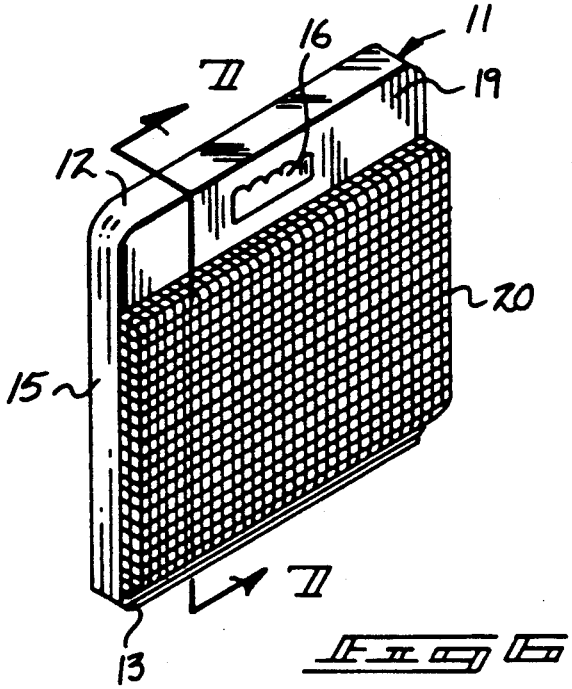
FIG. 6 is an isometric illustration of a defuser cage mounted on a forward surface of the instant invention.
Figure 7:
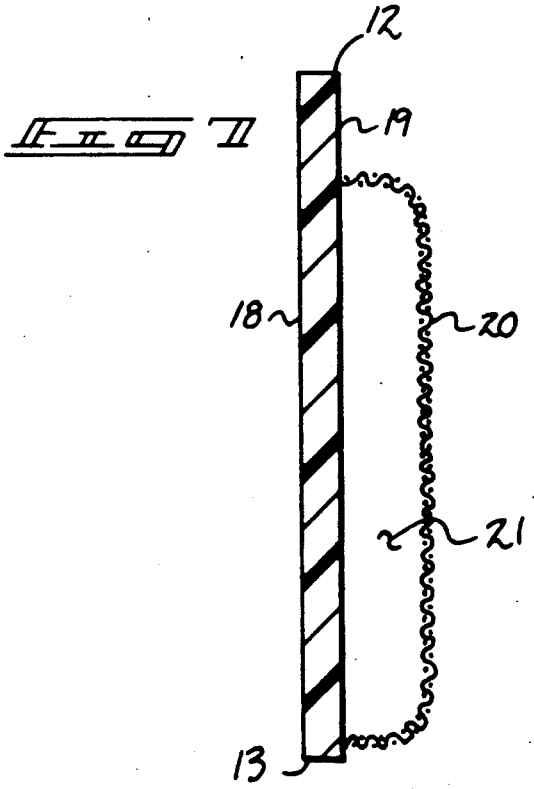
FIG. 7 is an orthographic side view taken along the lines 7—7 of FIG. 6 in the direction indicated by the arrows.
Figure 8:
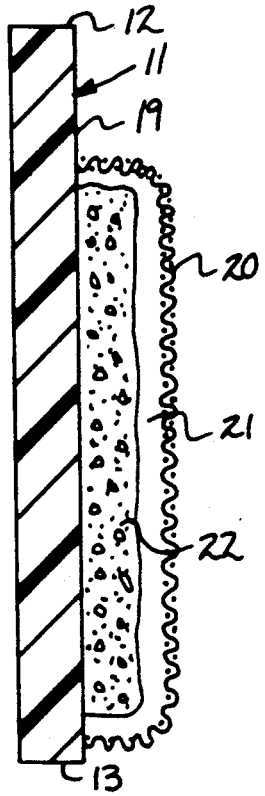
FIG. 8 is a cross-sectional orthographic view of the instant invention as illustrated in FIG. 6 utilizing a sponge insert layer.
Figure 9:
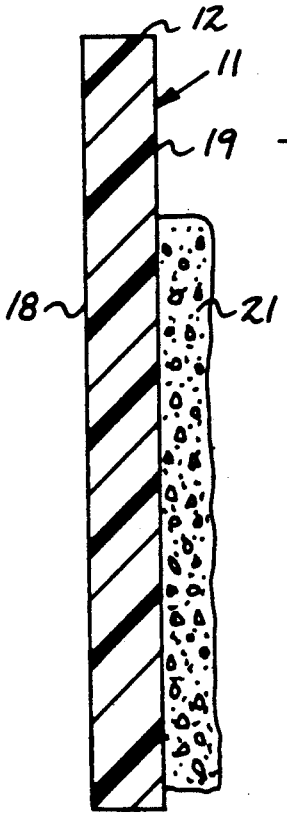
FIG. 9 is an orthographic cross-sectional view of the instant invention utilizing a sponge insert layer mounted to a forward face of the shield.

FIG. 6 illustrates the instant invention utilizing a mesh screen housing 20 overlying the forward surface 19 of the sheet 11 and extending coextensively from the bottom edge 13 upwardly to an orientation spaced below the elongate opening 16 wherein the upper edge of the housing 20 is aligned generally parallel to the opening 16 and the top and bottom edges 12 and 13. The screen housing 20 extends from the right side edge 14 to the left side edge 15 to overly the forward surface 19 and define a cavity 21 between the screen housing 20 and the forward surface 19.

Further, a sponge layer 22 (see FIG. 8) is optionally positionable and mounted interiorly of the housing 20 within the cavity 21 fixedly secured or adhered to the forward surface 19. The screen housing 20 provides the effect of diffusing and breaking up the water droplets directed by an associated sprinkler head 3. The sponge layer 22 provides the added advantage of absorbing such moisture and upon saturation of the sponge layer 22, excess water is dripped downwardly therefrom ensuring that an individual positioned behind the sheet 11 is afforded protection from water particles directed at the screen apparatus 10.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A sprinkler head shield apparatus for temporary positioning adjacent a sprinkler head to afford protection to an individual positioned behind the shield apparatus wherein the apparatus comprises, a rigid polymeric rectangular sheet, the sheet defined by a water impermeable member including a top edge spaced from and parallel to a bottom edge, and a right side edge spaced from and parallel to a left side edge wherein the member further includes a rear surface spaced from and parallel to a forward surface, and an elongate opening formed orthogonally through the sheet directed through the rear surface and forward surface and positioned adjacent the top edge and oriented parallel thereto, and the elongate opening includes an undulating finger engaging upper end surface to enhance manual grasping of the member by the elongate opening, and further including a mesh screen housing mounted integrally to the forward surface and enclosing the forward surface underlying the elongate opening and defining a cavity between the screen housing and the forward surface.

2. Apparatus as set forth in claim 1 wherein the screen housing is formed coextensively with the bottom edge and extends upwardly thereof to a position underlying the elongate opening and extends further from the right side edge continuously therewith to the left side edge and formed contiguously with the left side edge.

3. Apparatus as set forth in claim 2 wherein the cavity includes a sponge layer fixedly mounted to the forward surface interiorly of the mesh screen housing wherein the sponge layer is arranged coextensively with the cavity interiorly of the mesh screen housing.

* * * * *